US005350970A

United States Patent [19]

Vennix et al.

[11] Patent Number: 5,350,970

[45] Date of Patent: Sep. 27, 1994

[54] DISPLAY TUBE HAVING A DETACHABLE GETTER

[75] Inventors: Johannus A. Vennix; Johannes J. M. Overbeek, both of Eindhoven, Netherlands

[73] Assignee: U.S. Philips Corporation, New York, N.Y.

[21] Appl. No.: 976,825

[22] Filed: Nov. 16, 1992

[30] Foreign Application Priority Data

Nov. 18, 1991 [EP] European Pat. Off. ..... 91202980.8

[51] Int. Cl.[5] ..... H01J 29/84; H01J 31/00

[52] U.S. Cl. ..... 313/481; 313/560; 313/558

[58] Field of Search ..... 313/553, 560, 481, 479, 313/402, 407, 559, 558, 477 HC; 439/181, 182, 374, 375, 377, 360, 370, 345, 825

[56] References Cited

U.S. PATENT DOCUMENTS

| | | | |
|---|---|---|---|
| 4,130,328 | 12/1978 | Wessel | 439/825 |
| 4,182,974 | 1/1980 | Van Ijzeren | 313/481 |
| 4,230,966 | 10/1980 | Copen | 313/481 |
| 4,614,896 | 9/1986 | Josephs et al. | 313/481 |

*Primary Examiner*—Donald J. Yusko
*Assistant Examiner*—Vip Patel
*Attorney, Agent, or Firm*—Paul R. Miller

[57] ABSTRACT

A display tube has a getter structure which is clamped in an aperture of the magnetic shield. The getter structure and the screening cap may be of a simple construction and the getter structure can be replaced in a simple manner so that the display tube can be easily repaired. The getter structure is supported by the cone and the inner wall of the shield.

8 Claims, 5 Drawing Sheets

DISPLAY TUBE HAVING A DETACHABLE GETTER

The invention relates to a display tube comprising a neck, a cone and a display window, an electron gun being accommodated in the neck, an internal magnetic shield being arranged between the gun and the display window, an electrically conductive layer being present on the inner wall of the cone and the display tube composing a detachable getter structure which electrically contacts the conductive layer.

BACKGROUND OF THE INVENTION

Display tubes are used, inter alia, in television receivers.

Such a display tube is known from U.S. Pat. No. 4,182,974.

Within the scope of the invention, the term "getter" structure is to be understood to mean a part of the display tube which comprises at least a getter holder with getter material. The getter structure is heated during the manufacture of a display tube. In this process getter material is vaporized. The vaporization causes the pressure in the display tube to decrease. Sometimes, however, a display tube exhibits a defect which can be remedied by repairing the display tube. The display tube under repair is opened, i.e. the neck is opened and the vacuum in the display tube is interrupted. After the display tube has been repaired, the neck is closed and the display tube is evacuated. Subsequently, getter material is again vaporized. It is advantageous to replace the getter structure when the display tube is under repair. In the known display tube, the getter structure is secured to a projection on an anode contact located in the cone. The getter structure is secured in a manner such that it can be replaced. To replace the getter structure, the shield is provided with a groove which gives access to the anode contact.

Within the scope of the invention it has been recognized that the groove adversely affects the magnetic shielding and mechanical rigidity of the shield. A reduction of the magnetic shielding leads to picture errors. A reduction of the mechanical rigidity may lead to problems relating to microphonics.

SUMMARY OF THE INVENTION

It is an object of the invention to provide a display tube of the type mentioned in the opening paragraph, in which the getter structure can be replaced in a simple manner and the shield is improved.

To this end, a display tube according to the invention is characterized in that the shield comprises an inwardly extending portion at the end facing the neck, in that the getter structure projects from an aperture in this portion and is clamped in the aperture, a portion of the getter structure pressing against the cone and electrically contacting the electrically conductive layer, and a portion of the getter structure pressing against the inner wall of the shield, the aperture being situated between the portions of the getter structure.

In this portion of the shield there is an aperture from which the getter structure projects and in which the getter structure is clamped. Such an aperture can be made in a simple manner and has no or hardly any influence on the magnetic shielding and mechanical rigidity of the shield. By virtue thereof, the magnetic shielding by the magnetic shield and the mechanical rigidity of the shield are improved relative to the known display tube. A further advantage is that the anode contact does not have to be provided with a projection.

A getter structure can be replaced as follows: the getter structure is pulled out of the aperture or, in a preferred embodiment in which the getter structure is clamped in the aperture by means of resilient elements which can be moved toward each other, the resilient elements are moved toward each other after which the getter structure is detached. The getter is then removed from the display tube and a new getter structure is introduced into the display tube via the neck and inserted into the aperture and secured to the shield. The getter structure can be inserted by means of a device for inserting the getter structure into the aperture via the neck. The resilient elements press against the edge of the aperture, causing the getter structure to be clamped in the aperture. A part of the getter structure presses against the internal conductive layer and an electric contact between the getter structure and the conductive layer is formed. Another part presses against the inner wall of the magnetic shield. The getter structure may be of a simple construction. By virtue of these parts and the aperture between the parts, the position of the getter structure in the display tube is accurately defined. An accurate position of the getter structure is important, inter alia, when the getter structure material is vaporized by inductively heating the getter holder by means of an induction coil. Such induction coil is situated outside the display tube. The efficiency with which this process is carried out depends on the position of the getter holder and the induction coil relative to each other. The efficiency with which the getter material is vaporized increases as the position of the getter holder is more accurately defined.

A preferred embodiment of the display tube according to the invention is characterized in that the portion facing the gun is a flat portion which extends approximately parallel to the display window, in that the shield comprises a conical portion and the aperture is situated in the flat portion near the transition between the conical portion and the flat portion.

The getter structure can be accurately positioned by providing the aperture in the shield at the indicated location.

A further embodiment of the display tube according to the invention is characterized in that the shield is provided with guide means for guiding the getter structure to the aperture.

This simplifies the insertion of the getter structure into the aperture. When the getter structure is introduced into the tube, the guiding ridges guide the getter structure to the aperture.

A preferred embodiment of the display tube according to the invention is characterized in that the resilient elements are parts of a resilient bracket and are provided with indentations.

BRIEF DESCRIPTION OF THE DRAWING FIGURES

These indentations allow interlocking between the bracket and the aperture.

The invention will be explained in greater detail by means of an exemplary embodiment of the display device according to the invention and with reference to the accompanying drawings, in which FIG. 1 is a longitudinal cross-sectional view of a display device in accordance with the invention;

Figure 1:
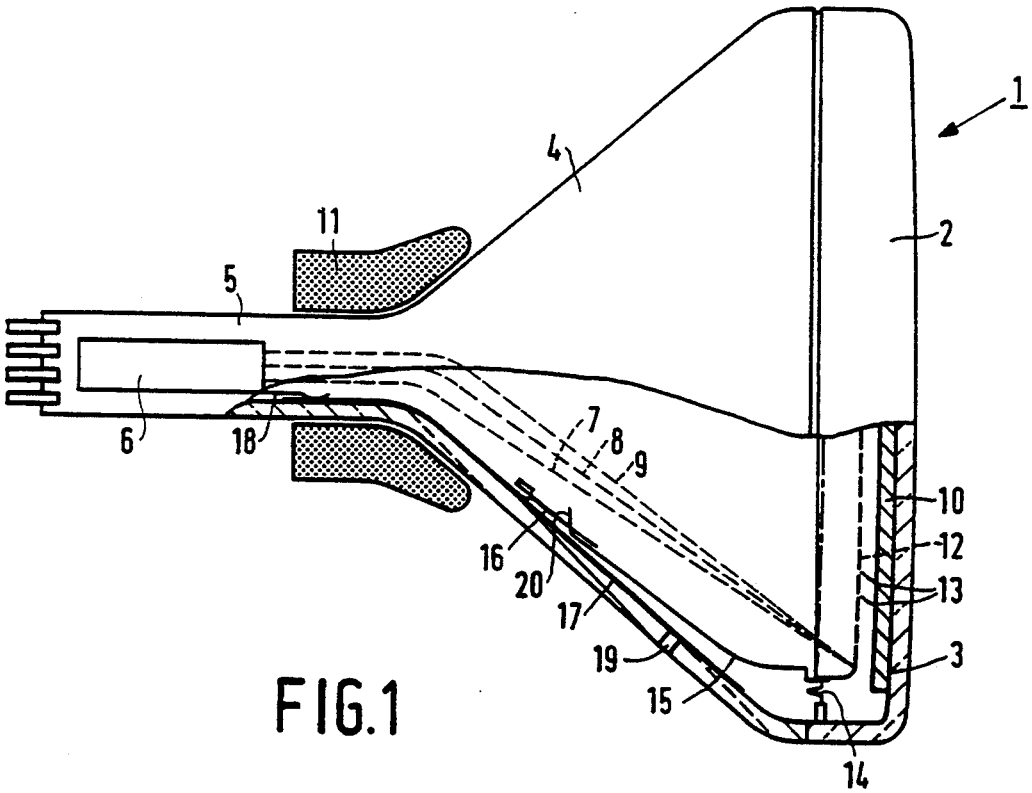

FIGS. *6a, 6b* and *6c* show a device for inserting a getter structure via the neck.

The Figures are not drawn to scale. In the Figures, corresponding parts generally bear the same reference numerals.

DESCRIPTION OF THE INVENTION

A display tube, in this example colour cathode ray tube 1, has an evacuated envelope 2 comprising a display window 3, a cone 4 and a neck 5. In the neck there is situated an electron gun 6 for generating three electron beams 7, 8 and 9. A display screen 10 having phosphor elements luminescing in red, green and blue is situated on the inside of the display window. On their way to the display screen 10 the electron beams 7, 8 and 9 are deflected across the display screen 10 by means of deflection unit 11 and pass through shadow mask 12 which comprises a thin plate having apertures 13. The electron beams 7, 8 and 9 pass through the apertures 13 at a small angle and each electron beam impinges on phosphor elements of only one colour. The shadow mask is suspended in the display tube by means of suspension means 14. The display tube comprises a magnetic shield 15. This screening cap may, for example, be secured to the shadow mask at a supporting edge or supporting comers for the shadow mask or to suspension means. By virtue of the magnetic shield, the influence of disturbing magnetic fields, such as the earth's magnetic field, on the deflection of the electron beams is reduced. A getter structure 16 is secured to the shield. A conductive layer 17 is applied to the inner wall of the cone and, inter alia, electrically contacts the electron gun, for example, v/a springs 18 and electrically contacts the getter structure 16. An electric potential can be applied to the conductive layer via an anode contact 19. The shield 15 comprises an inwardly extending portion 20 at the end facing the neck 4. As shown in this example, the portion 20 may extend approximately transversely to the axis of the cone. In a process step in the manufacture of the display tube, the getter holder is heated so as to vaporize the getter material. This causes the pressure in the display tube to be reduced. When the display tube is under repair the neck is opened. After the display tube has been repaired the neck is closed and the display tube is again evacuated. Subsequently, getter material is vaporized again. A getter structure which has not been used works better than a getter structure which has already been used. Consequently, it is advantageous to replace the getter structure of the display tube under repair.

In the display tube known from U.S. Pat. No. 4,182,974, the anode contact is provided with a projection to which the getter structure is secured. The shield has a groove which extends from the end of the shield facing the electron gun to beyond the anode contact. As a result thereof the magnetic protection provided by the shield in the vicinity of the groove is reduced. The mechanical strength and rigidity of the shield are reduced by the groove. The invention aims at providing a display tube having an improved magnetic protection and a stronger shield.

Figure 2A:
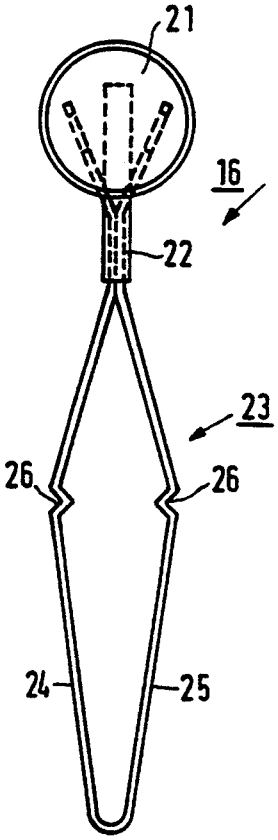
FIGS. 2A, 2B and 2C are a front view, rear view and side view, respectively, of a getter for a display tube in accordance with the invention.
Figure 2B:
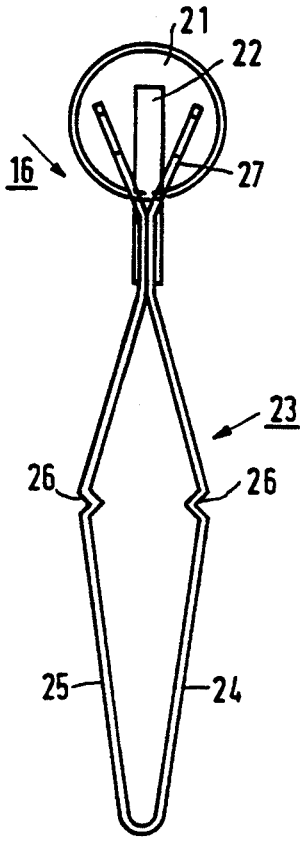
Figure 2C:
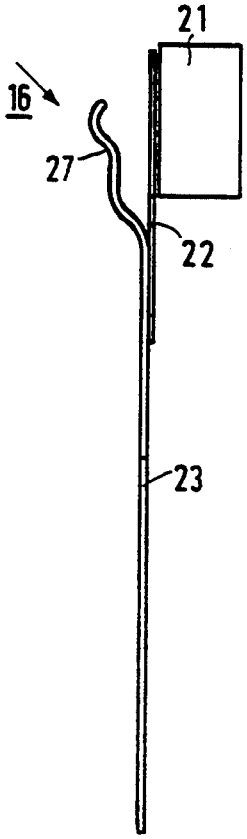

FIGS. 2A, 2B and 2C are a front view, rear view and side view, respectively, of a getter structure which can suitably be used for a display tube in accordance with the invention.

Getter 16 has a getter holder 21 containing getter structure material. The getter holder 21 is attached to a resilient bracket 23 by means of a rod 22. The resilient bracket 23 comprises two portions 24 and 25 which can move relative to one another. These portions comprise indentations 26. The bracket further comprises limbs 27 which ensure that the getter holder 21 is kept at some distance from the cone.

Figure 3:
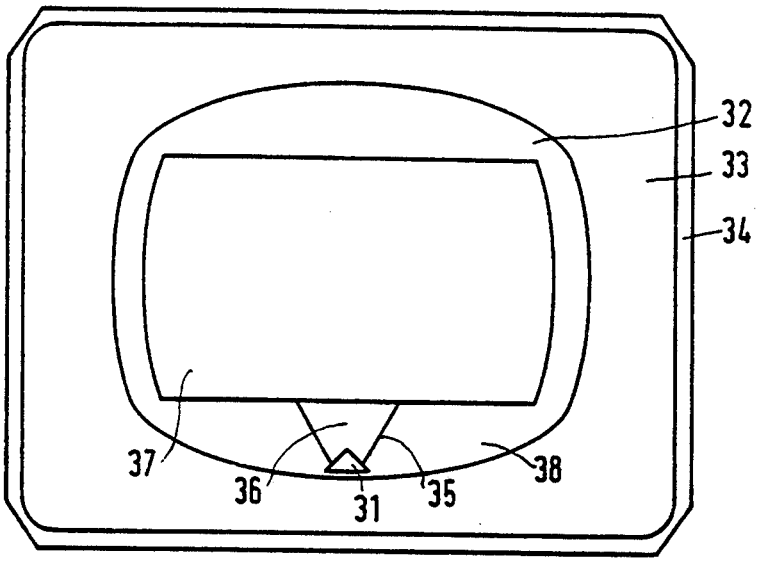
FIG. 3 is an elevational view of a shield of a display tube in accordance with the invention, viewed from the neck.

FIG. 3 is an elevational view of a shield viewed from the neck. The shield 15 has an inwardly extending flat surface 32 which corresponds to portion 20 in FIG. 1, a cone portion 33 and an edge 34. An aperture 31 is situated in the flat surface near the transition between the flat surface and the cone portion. In this example the distance between the aperture and the transition ranges between approximately 1 and 10 min. By virtue of the position of the aperture, the aperture 31 has no or substantially no adverse effect on the strength of the flat surface 32. A weakened flat surface may lead to a variation in the position of the aperture, causing the accuracy with which the getter structure is positioned to be reduced. The getter structure is secured to the shield by introducing the bracket 23 into the aperture 31 until the edge of the aperture and the indentations interlock. When the getter structure is fed through the neck, the aperture is not visible from the neck. Within the scope of the invention it has been recognized that this could cause problems. In this example, guiding ridges 35 are formed in the flat surface 32 in the vicinity of the aperture 31. During inserting the getter structure, the ridges guide the getter structure to the aperture 31. By virtue of such means the getter structure can be secured more easily. The guiding ridges 35 may consist of two ridges projecting from surface 32. In an embodiment, portion 36 of surface 32, which is located between the ridges 35 is recessed relative to portions 37 and 38 which are located on either side of the ridges, and ridges 35 are formed by transitions between portion 36 and portions 37 and 38.

Figure 4:
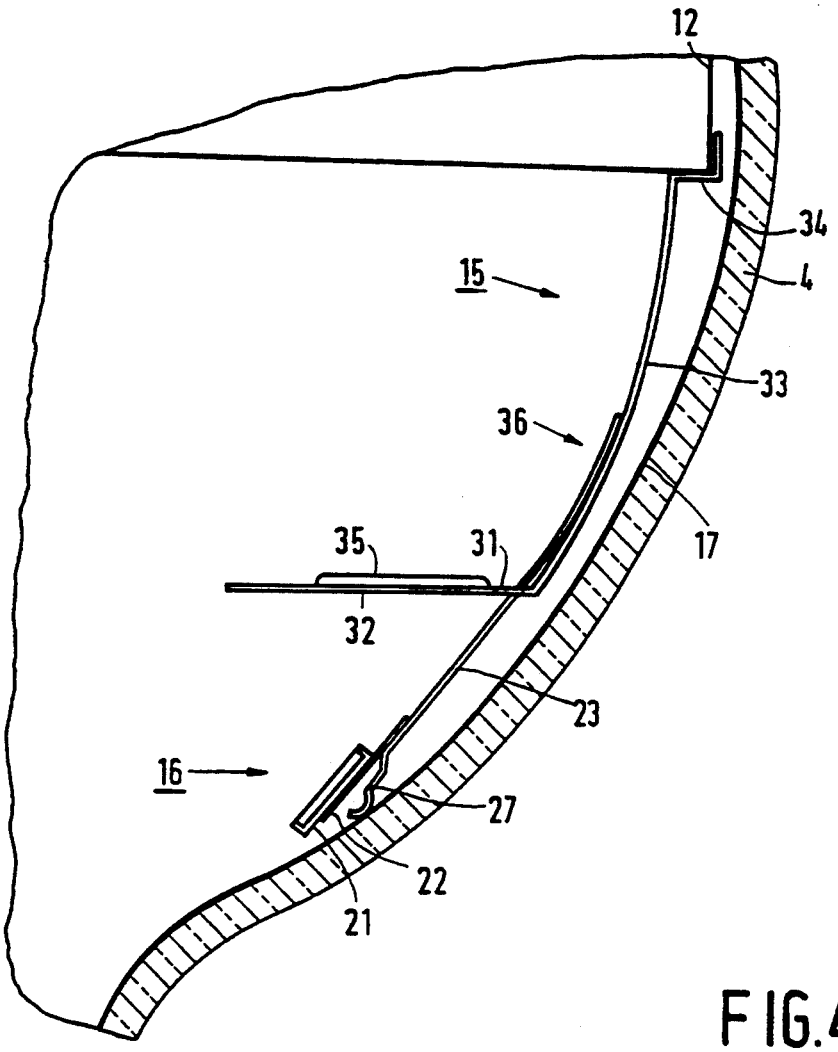
FIG. 4 is a sectional view of a detail of a display tube in accordance with the invention.

FIG. 4 is a sectional view of a detail of a display tube in accordance with the invention. Movable parts 24 and 25 (not shown) are clamped in aperture 31 of the shield 15 causing the getter structure 16 to be secured to the shield in a self-clamping manner. The edge of aperture 31 and the indentations 26 (not shown) interlock. By means of the indentations the getter structure can be accurately positioned. The getter structure lies against the cone with limbs 27. The inside of the cone is provided with a conductive layer 17 which is in electric contact with the getter structure via the limbs 27. In operation, the layer 17 carries high voltage. The portion 36 of the getter structure lies against the inner wall of the shield. The aperture 31 is situated between the limbs 27 and portions 36 of the getter structure. The position of the getter structure is accurately defined by limbs 27, portion 36 and aperture 31. Getter structure 16 can be removed in a simple manner. The getter structure can be pulled out of aperture 31 by introducing a hook into the display tube through the neck, hooking the hook between the portions 24 and 25 and pulling it. Preferably the getter structure is detached without exerting forces on the shield by moving the movable parts 24 and 25 toward each other. In order not to change the position of the shield, the getter structure is preferably detached without exerting a large force on the shield by moving the movable parts 24 and 25 toward each other. By virtue thereof, the clamping force is eliminated and the getter structure becomes detached. Also in detaching the getter structure, the guide means, in this example guiding ridges 35, are useful; they can lead a device which is used to detach the getter structure to the getter structure.

Figure 5:
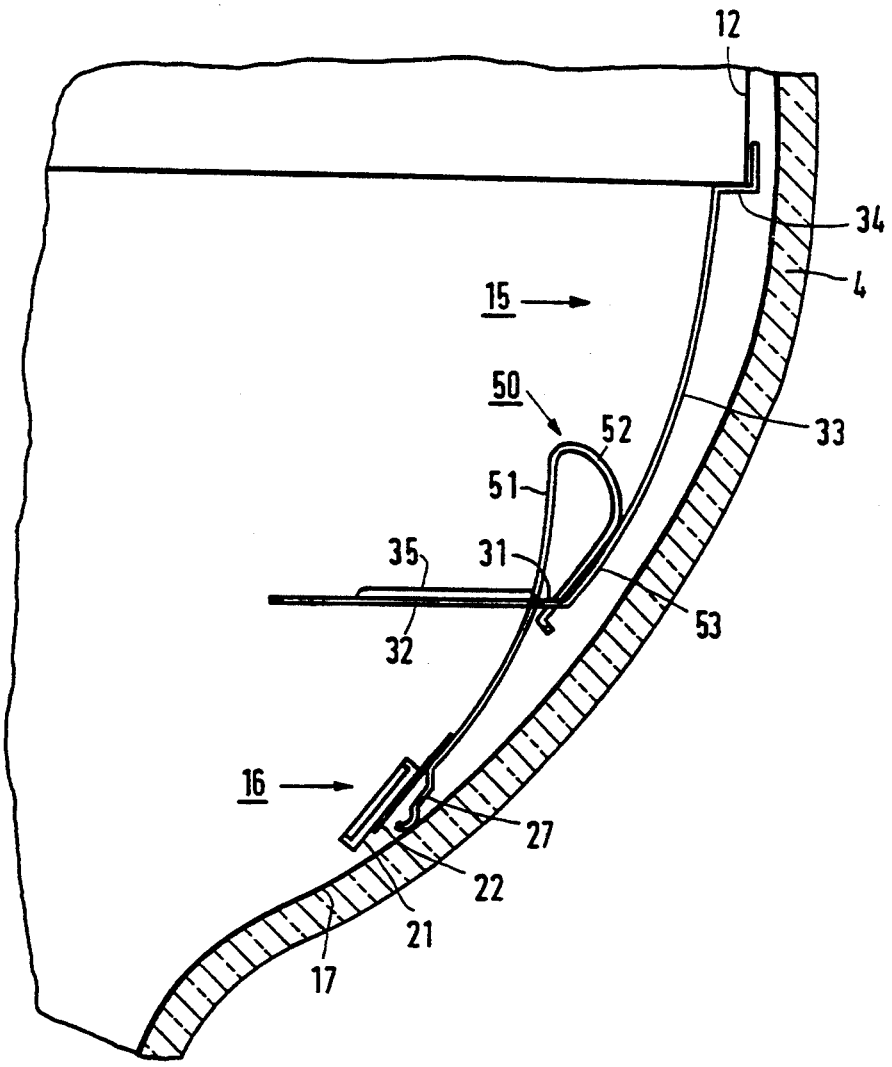
FIG. 5 is a sectional view of a detail of a further example of a display tube in accordance with the invention.

FIG. 5 is a sectional view of a detail of an embodiment of a display tube in accordance with the invention. This embodiment differs from the one shown in FIG. 4 in that bracket 23 is replaced by a spring 50 comprising two movable portions 51 and 52. The portions 51 and 52 may have indentations which interlock with the edge of the aperture. The spring is bent toward the cone 4. Aperture 31 is situated between limb 27 of the getter structure which lies against the inner wall of the cone and portion 52 which, in point 53, lies against the inner wall 33 of the shield.

Figure 6A:
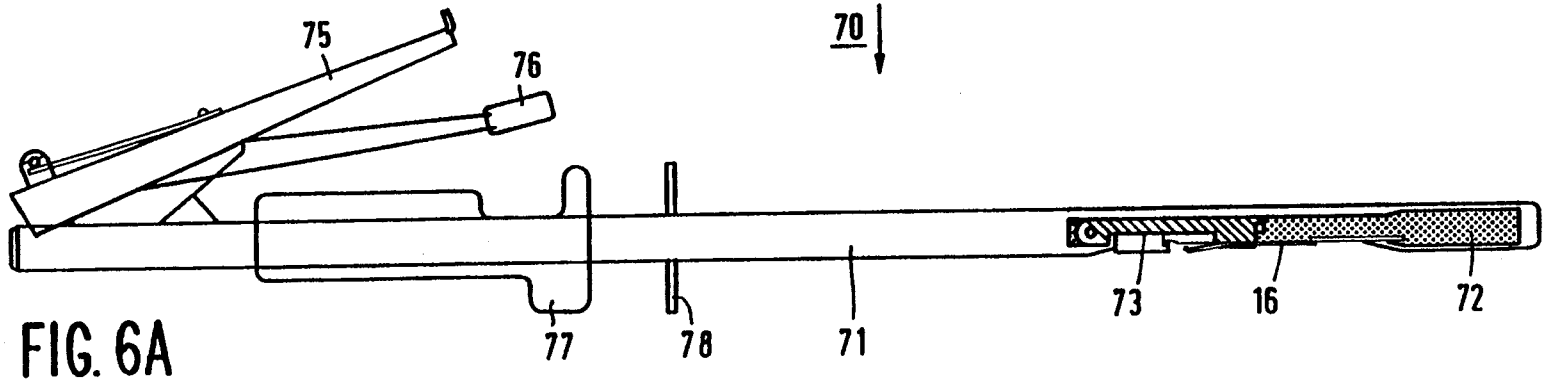
Figure 6B:
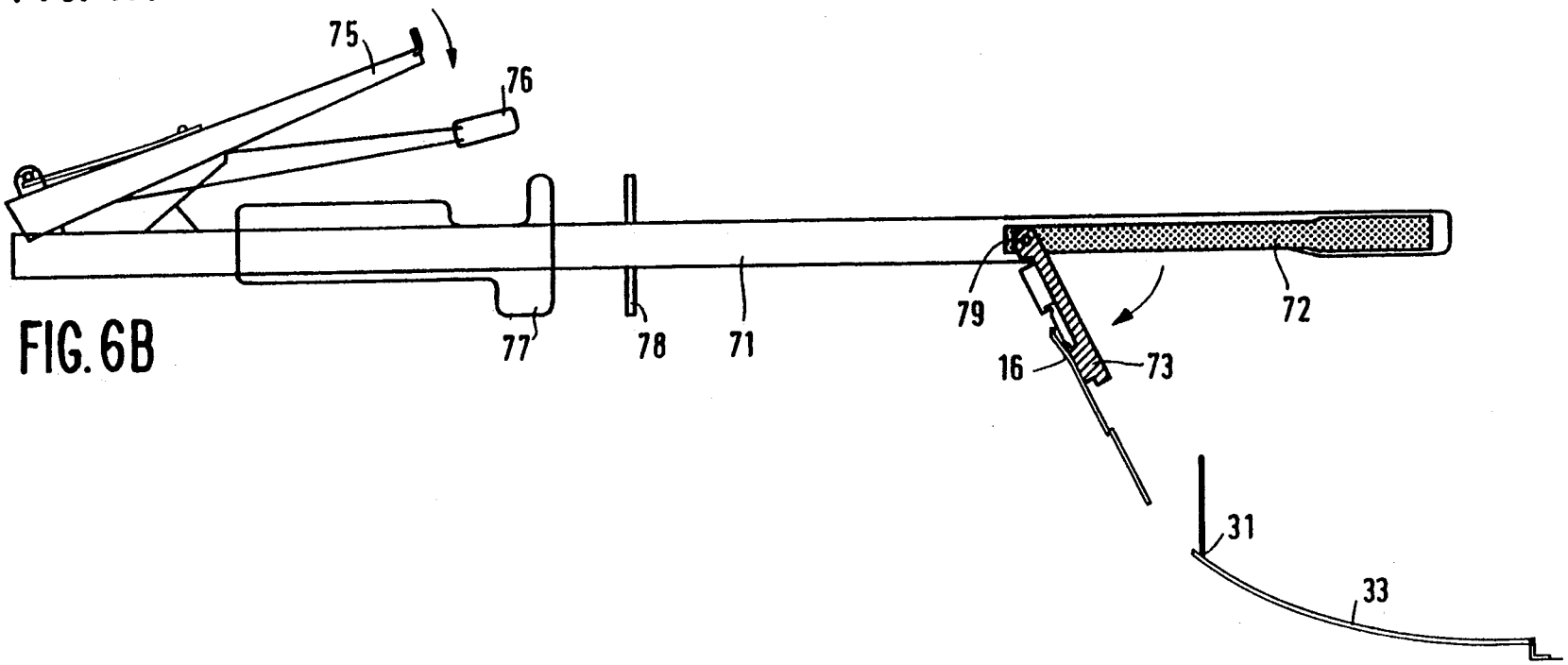
Figure 6C:
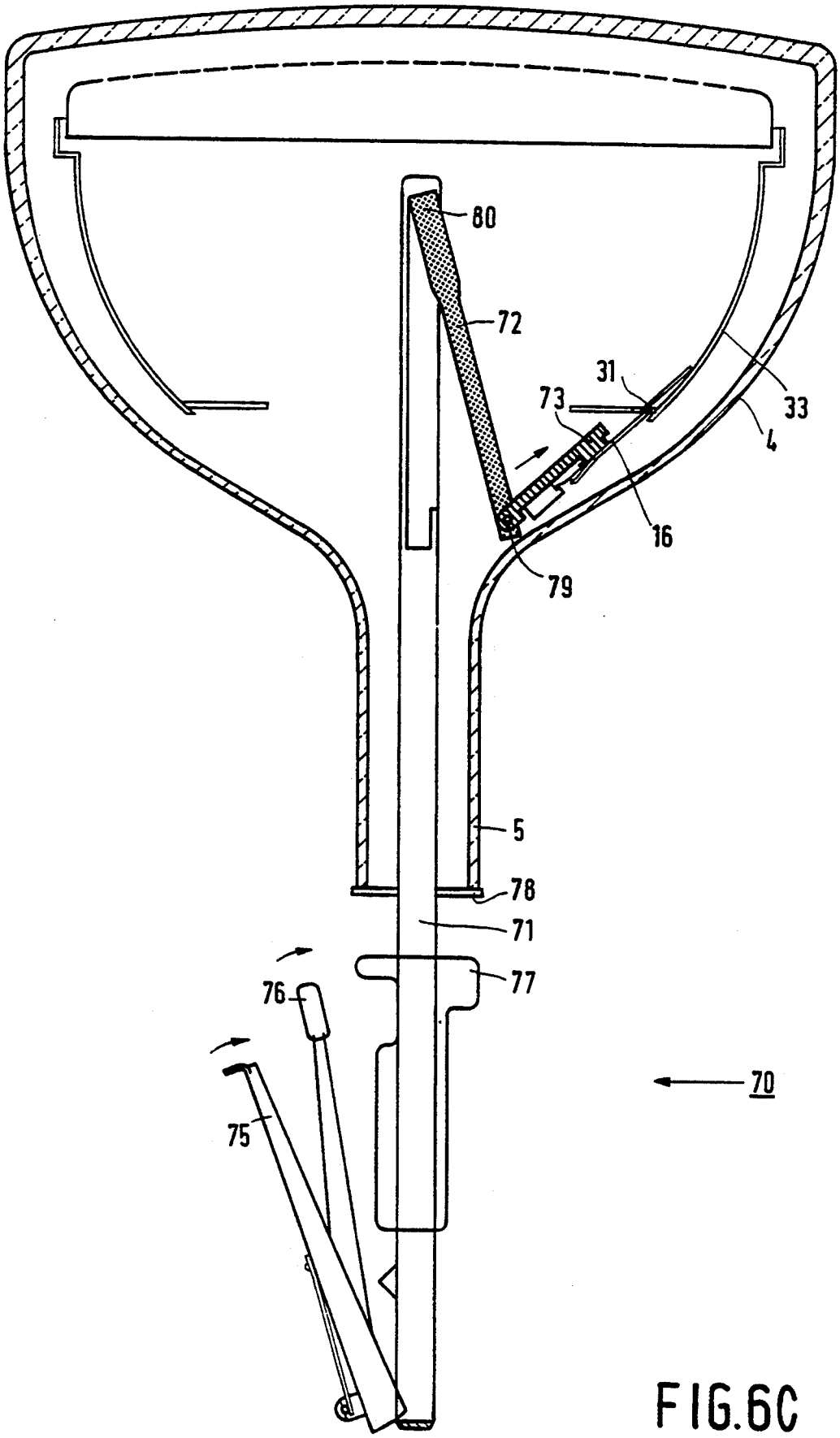

One aspect of the invention is formed by the insight that the getter structure can be replaced, preferably, in a simple manner via the neck. If a used getter structure has been removed, a replacement getter structure can be secured to the shield by means of, for example, an insertion device as diagrammatically shown in FIGS. 6*a* up to and including 6*c*. The insertion device 70 comprises a central portion 71, collapsible portions 72 and 73, levers 75 and 76, handle 77 and a flange 78. Getter structure 16 is secured in portion 73. The insertion device is introduced into the neck of a display tube until flange 78 contacts the edge of the neck. By pressing-in lever 75, portion 73 is caused to swing out (FIG. 6*b*). By further pressing-in lever 75, portion 72 is caused to swing out. As a result thereof, getter structure 16 is inserted into aperture 31 of the shield. Subsequently, lever 76 is pressed-in causing the getter structure 16 to become detached from portion 73. Portions 72 and 73 then collapse and the insertion apparatus 70 is removed from the neck.

It will be obvious that within the scope of the invention many variations are possible to those skilled in the art.

In the example given, the shield has a triangular aperture. In other embodiments the aperture may be of a different shape, for example, diamond-shaped or slit-shaped.

In the display tube in accordance with the invention, the getter structure can be secured before or after the display window and the cone are bonded together. This enables both frittable and non-frittable getter structures to be used. The difference between these two types of getter structures resides in that a frittable getter can withstand the temperature prevailing during bonding together the display window and the cone, whereas a non-frittable getter structure cannot withstand the temperature. Within the scope of the invention, the term getter structure is to be understood to mean a part of the display tube which comprises at least a getter holder for getter material and a connection between the getter holder and another part of the display tube. Within the scope of the invention, the expression "conductive layer" is to be understood to mean also a resistive layer. The inwardly directed part may extend, as shown in the example, transversely to the tube axis but it may also make an angle with the axis.

We claim:

1. A display tube comprising (a) an envelope including a neck, a cone and a display window;

(b) an electron gun accommodated in the neck;

(c) an internal magnetic shield arranged between said electron gun and said display window, said magnetic shield including an inwardly extending portion at an end facing said neck, said inwardly extending portion having an aperture;

(d) an electrically conductive layer present on an inner wall of said cone; and (e) a detachable getter structure electrically contacting said conductive layer, said getter structure having a first portion projecting through said aperture and being clamped therein, said getter structure having a second portion electrically contacting said electrically conductive layer by pressing against said inner wall of said cone, and said getter structure having a third portion pressing against an inner wall of said magnetic shield, wherein said aperture is situated between said second and third portions.

2. A display tube according to claim 1, wherein said getter structure has resilient elements clamped in said aperture, said resilient elements being movable toward each other.

3. A display tube according to claim 2, wherein said internal magnetic shield includes a conical portion from which said inwardly extending portion extends as a flat portion parallel to said display window, and wherein said aperture is disposed in said flat portion near a transition between said conical portion and said flat portion.

4. A display tube according to claim 3, wherein said magnetic shield includes guide means for guiding said getter structure to said aperture.

5. A display tube according to claim 2, wherein said resilient elements are parts of a resilient bracket and are provided with indentations for clamping in said aperture.

6. A display tube according to claim 2, wherein said magnetic shield includes guide means for guiding said getter structure to said aperture.

7. A display tube according to claim 1, wherein said internal magnetic shield includes a conical portion from which said inwardly extending portion extends as a flat portion parallel to said display window, and wherein said aperture is disposed in said flat portion near a transition between said conical portion and said flat portion.

8. A display tube according to claim 1, wherein said magnetic shield includes guide means for guiding said getter structure to said aperture.

* * * * *